US008870601B2

(12) United States Patent
Lee

(10) Patent No.: US 8,870,601 B2
(45) Date of Patent: Oct. 28, 2014

(54) USB CONNECTOR MODULE

(71) Applicant: Rich Electric Wire and Cable Co. Ltd., Yunlin County (TW)

(72) Inventor: Chang-Chi Lee, Yunlin County (TW)

(73) Assignee: Rich Electronic Wire and Cable Co., Ltd., Yunlin County (TW)

( * ) Notice: Subject to any disclaimer, the term of this patent is extended or adjusted under 35 U.S.C. 154(b) by 134 days.

(21) Appl. No.: 13/761,374

(22) Filed: Feb. 7, 2013

(65) Prior Publication Data

US 2014/0179166 A1 Jun. 26, 2014

(30) Foreign Application Priority Data

Dec. 26, 2012 (CN) ..... 2012 1 0575528

(51) Int. Cl.
*H01R 25/00* (2006.01)
*H01R 31/06* (2006.01)

(52) U.S. Cl.
CPC ..... *H01R 31/06* (2013.01)
USPC ..... 439/638; 439/131; 439/501

(58) Field of Classification Search
CPC ..... H01R 31/06
USPC ..... 439/628, 639, 638, 501, 131, 623
See application file for complete search history.

(56) References Cited

U.S. PATENT DOCUMENTS

| | | | | |
|---|---|---|---|---|
| 6,991,483 | B1 * | 1/2006 | Milan et al. | 439/171 |
| 7,136,288 | B2 * | 11/2006 | Hoogerdijk | 361/737 |
| 7,942,691 | B1 * | 5/2011 | McSweyn | 439/501 |
| 8,491,330 | B2 * | 7/2013 | McSweyn | 439/501 |

* cited by examiner

*Primary Examiner* — Hae Moon Hyeon
(74) *Attorney, Agent, or Firm* — Ming Chow; Sinorica, LLC

(57) ABSTRACT

A USB connector module has a main member, two connectors, and two adapters. The main member has four recesses and four sockets on sidewalls of the recesses to detachably engage the connectors and the adapters. The connectors are connected through a cable, and the cable passes through a bore of the main member and is able to be squeezed in a slot of the main member. The connectors and the adapters are able to be pulled out for connecting to electronic devices or to be engaged with the main member for storage.

9 Claims, 9 Drawing Sheets

USB CONNECTOR MODULE

The current application claims a foreign priority to the patent application of China No. 201210575528.2 filed on Dec. 26, 2012.

BACKGROUND OF THE INVENTION

1. Field of the Invention

The present invention relates generally to a signal connector, and more particularly to a USB connector module.

2. Description of the Related Art

Universal Serial Bus (USB) is an industry standard that defines the cables, connectors and communications protocols used in a bus for connection, communication and power supply between various electronic devices, such as a mouse and a keyboard for a computer, digital TV, video game set, and camera.

As described above, there are a variety of USB ports on various electronic devices. Each USB port only designed for a specified USB connector, therefore there are a variety of USB connectors in the market. It is very inconvenient to carry various connectors for different electronic devices.

SUMMARY OF THE INVENTION

The primary objective of the present invention is to provide a USB connector module, which is convenient for carry and storage.

According to the objective of the present invention, a USB connector module includes a cable; a first connector having a first plug connected to an end of the cable; a second connector having a second plug connected to an opposite end of the cable; at least an adapter having a third plug and a socket, wherein the third plug is electrically connected to the socket, and the first plug of the first connector is able to engage the socket; and a main member having a first socket to detachably engage the first plug of the first connector, a second socket to detachably engage the second plug of the second connector, and a third socket to detachably engage the third plug of the adapter.

Therefore, the USB connector module of the present invention may be operated and stored in an easy way.

DETAILED DESCRIPTION OF THE INVENTION

Figure 1:
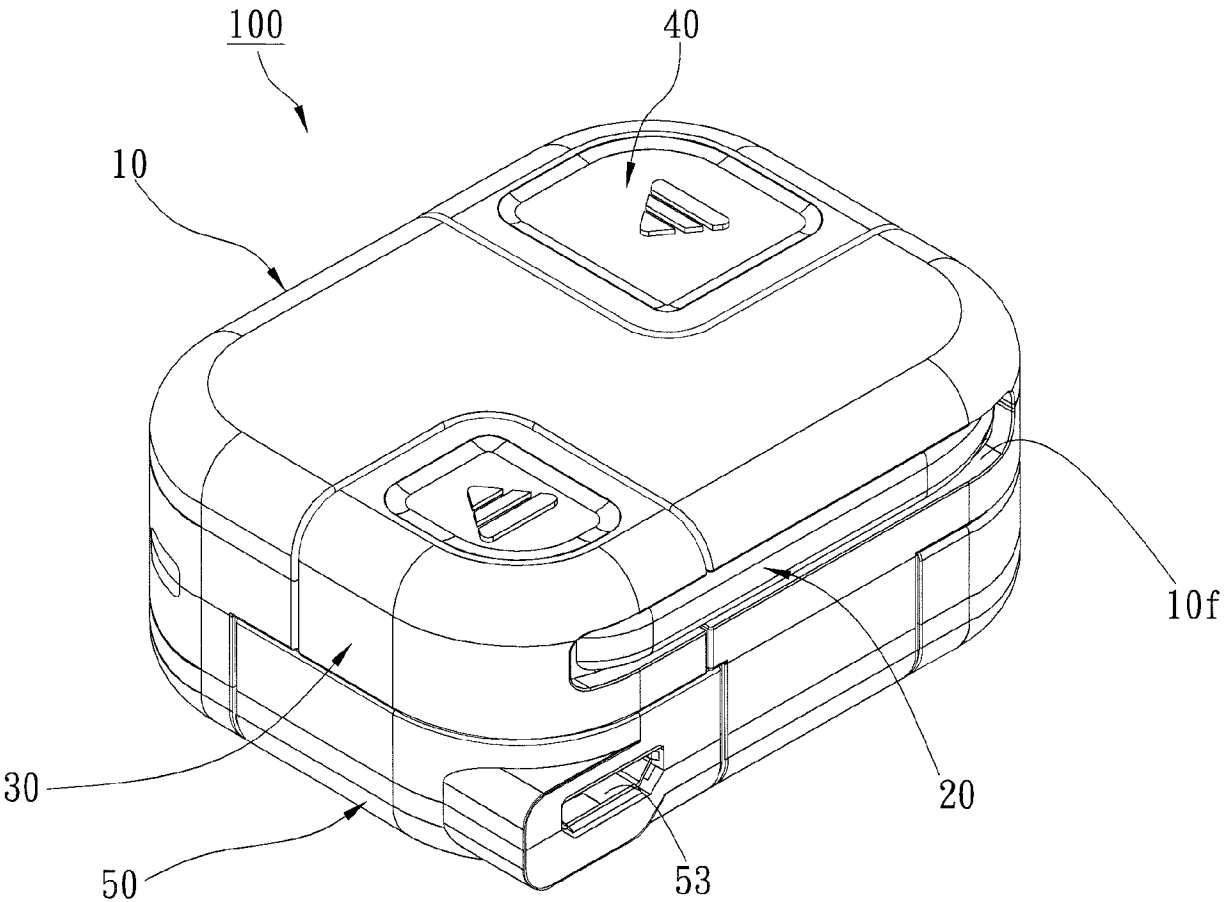
FIG. 1 is perspective views of a preferred embodiment of the present invention.
Figure 2:
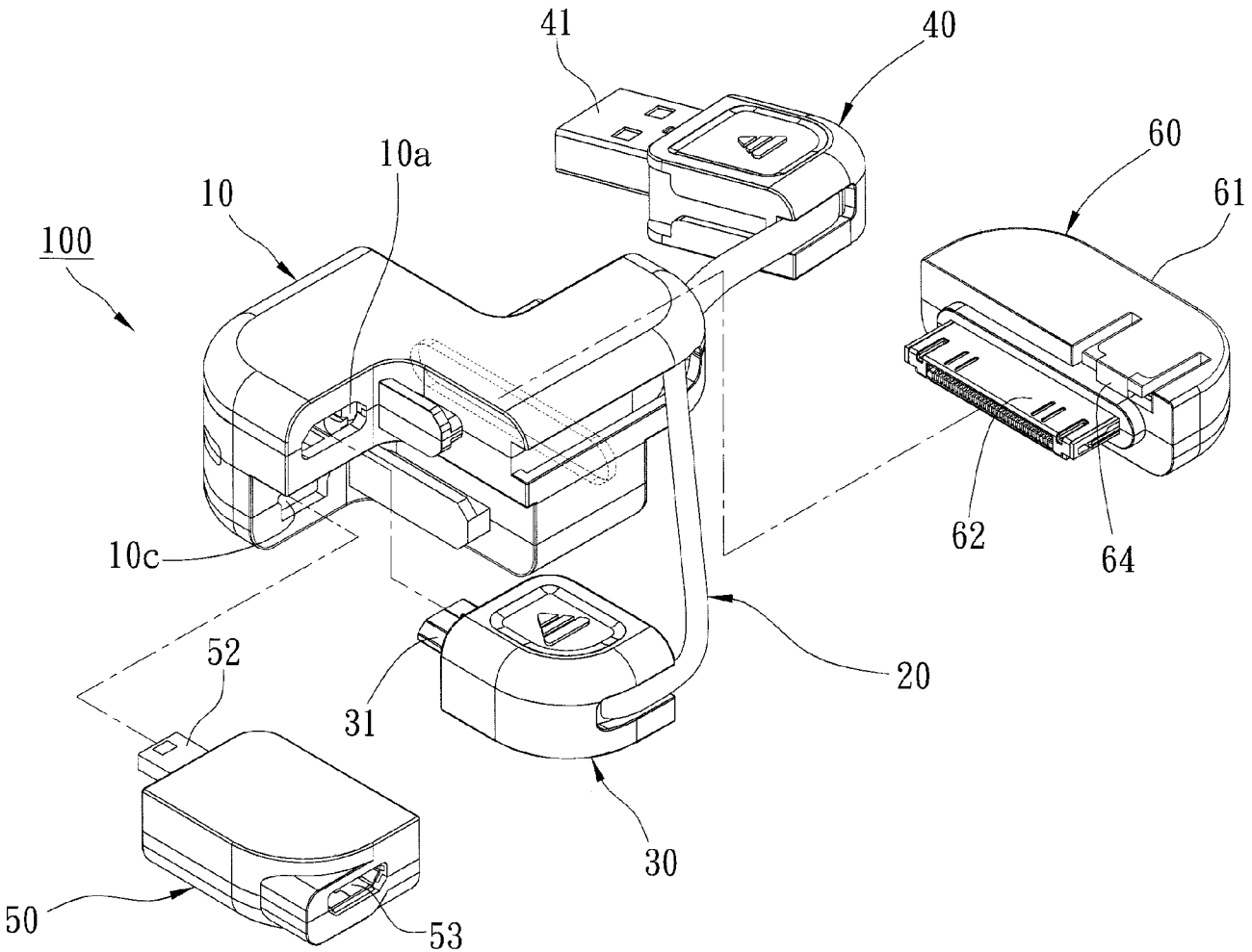
FIG. 2 is an exploded view of the preferred embodiment of the present invention.
Figure 3:
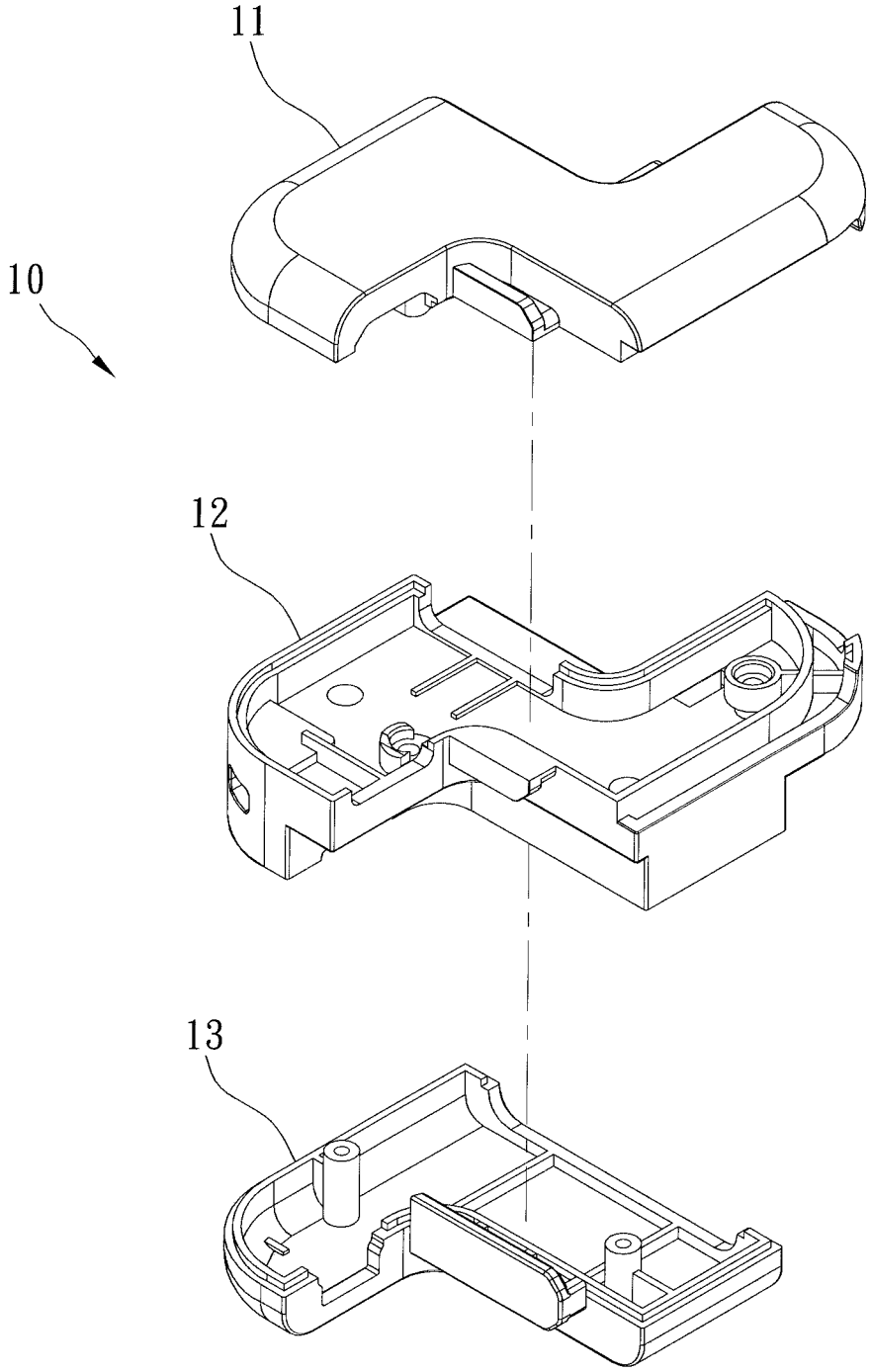
FIG. 3 is an exploded view of the main member of the preferred embodiment of the present invention.
Figure 4:
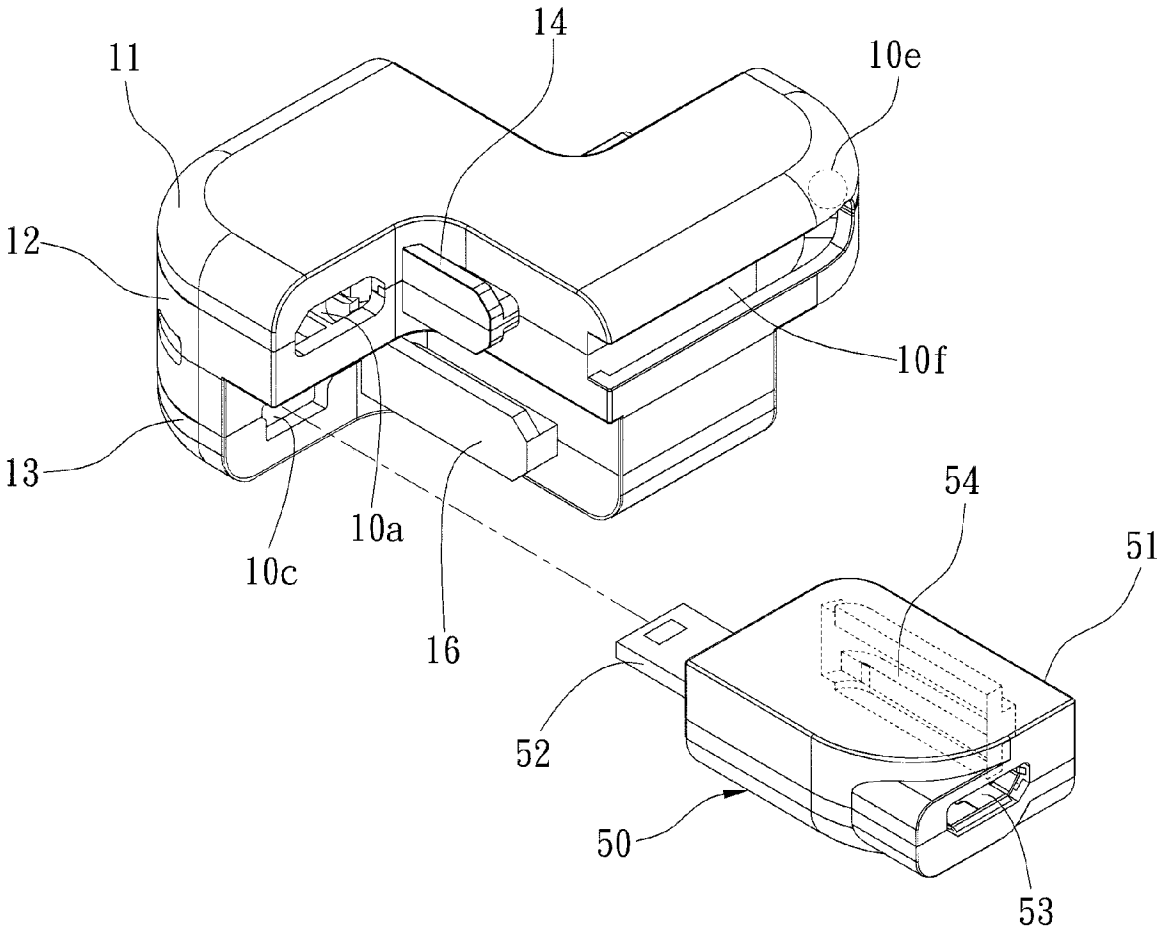
FIG. 4 is a perspective view of the preferred embodiment of the present invention, showing engagement of the main member and the adapter.
Figure 5:
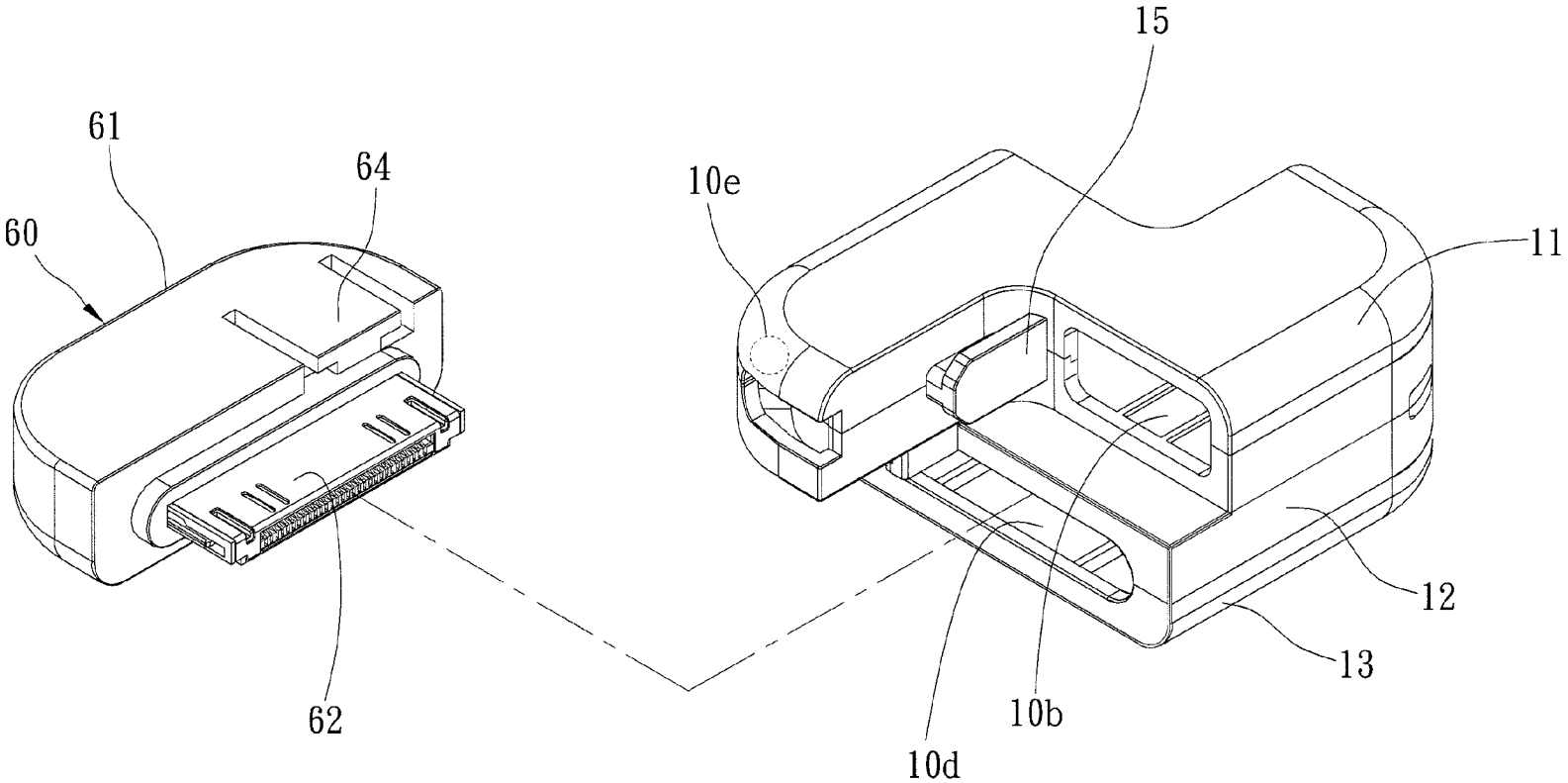
FIG. 5 is a perspective view of the preferred embodiment of the present invention, showing engagement of the main member and another adapter.

FIG. 1 and FIG. 2 show a USB connector module 100 of the preferred embodiment of the present invention, including a main member 10, a cable 20, a first connector 30, a second connector 40, and two adapters 50 and 60.

As shown in FIGS. from FIG. 3 to FIG. 6, the main member 10 has a first casing 11, a second casing 12, and a third casing 13 in serial butt connection. The main member 10 has a first socket 10*a* and a second socket 10*b* between the first casing 11 and the second casing 12, and a third socket 10*c* and a fourth socket 10*d* between the second casing 12 and the third casing 13. These sockets 10*a*-10*d* have different sizes and shapes.

The main member 10 further has a bore 10*e* between the first casing 11 and the second casing 12 and a cable slot 10*f* communicated with the bore 10*e*. The cable 20 passes through the bore 10*e* and is squeezed in the cable slot 10*f* for storage. As shown in FIG. 1, the cable 20 in the cable slot 10*f* provides the USB connector module 100 with an integrated aspect. The bore 10*e* is smaller than the first connector 30 and the second connector 40.

Figure 6:
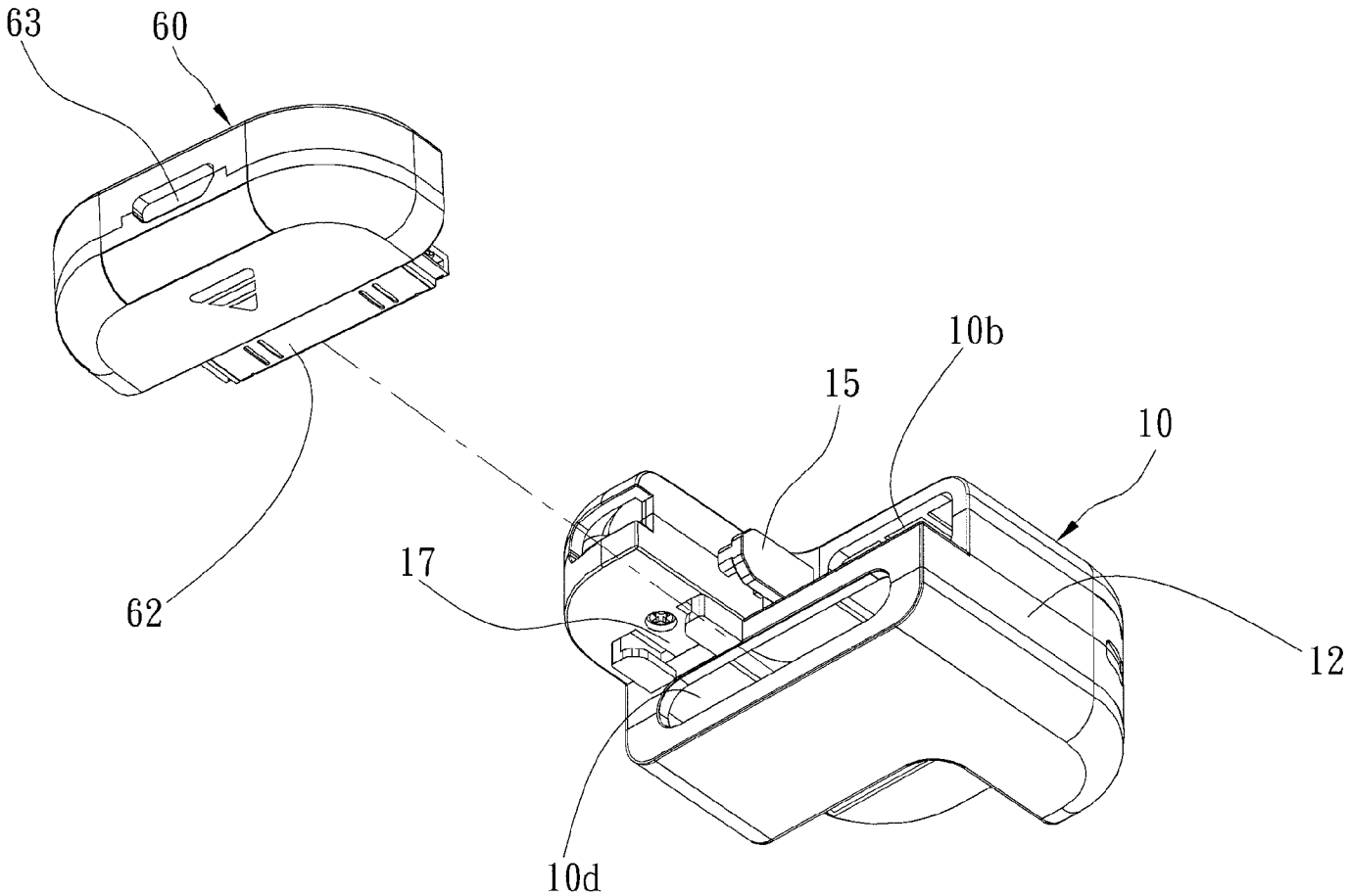
FIG. 6 is another perspective view of FIG. 5.

The main member 10 further has two protrusions 14, 15 between the first casing 11 and the second casing 12 and a protrusion 16 between the second casing 12 and the third casing 13 to form a first, a second, and a third guiding portions. These protrusions 14-16 are T-shaped beams. The main member 10 further has a slot 17 on the second casing 12 (FIG. 6).

Figure 7:
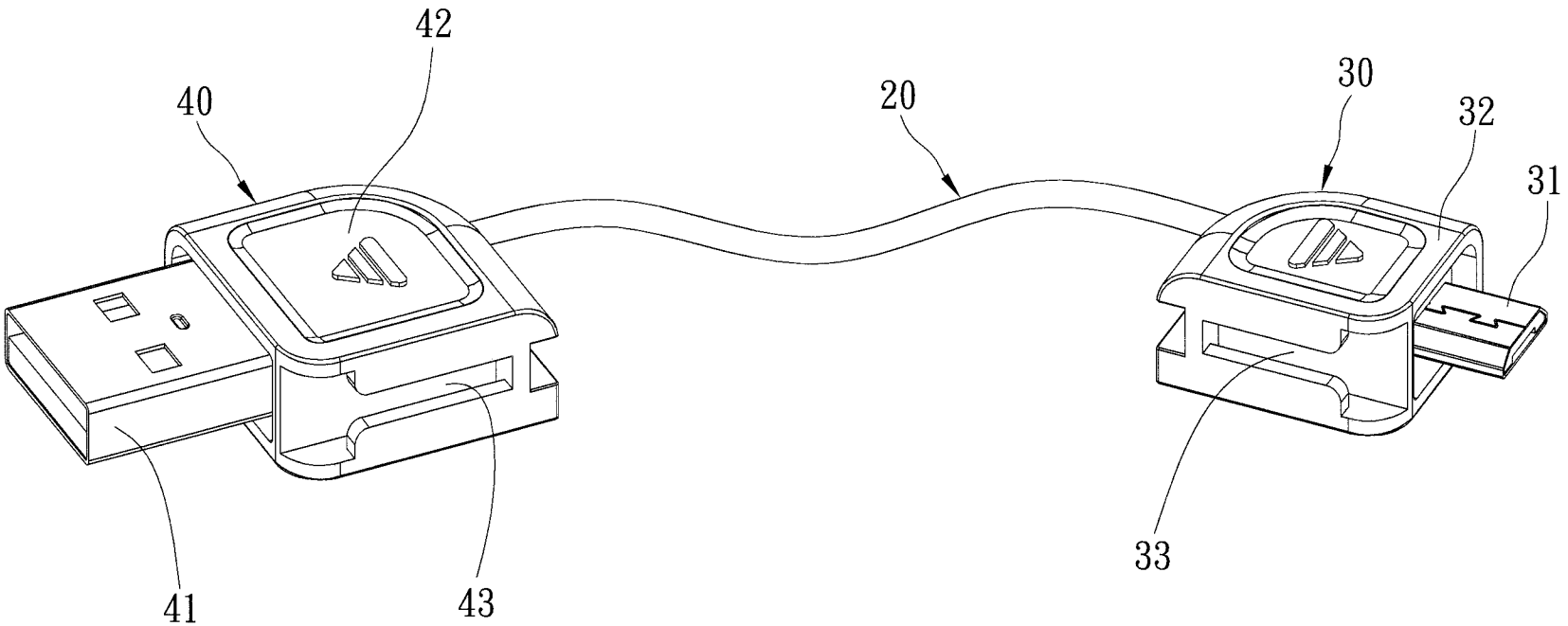
FIG. 7 is a perspective view of the preferred embodiment of the present invention, showing the connection of the first connector and the second connector.

As shown in FIG. 7, the first connector 30 has a first plug 31 and a first housing 32. The first plug 31 is mounted on the first housing 32 and is connected to an end of the cable 20. The first housing 32 has a slot 33 to form a first connecting portion. The first plug 31 is able to be inserted into the first socket 10*a*, and the slot 33 slidably engages the protrusion 14 to mount the first connector 30 on the main member 10. It is noted that the main member 10 has a recess which receives the first housing 32 of the first connector 30, and the first socket 10*a* is on a sidewall of the recess.

The second connector 40 has a second plug 41 and a second housing 42. The same as the first connector 30, the second plug 41 is connected to the other end of the cable 20, and the second housing 42 has a slot 43 to form a second connecting portion. The second plug 41 is inserted into the second socket 10*b*, and the slot 43 slidably engages the protrusion 15 to mount the second connector 40 on the main member 10. The main member 10 has a recess which receives the second housing 42 of the second connector 40, and the second socket 10*b* is on a sidewall of the recess.

The first connector 30 and the second connector 40 are able to be pulled out to connect to specific electronic devices respectively. They are connected to the main member 10 as described above for storage. The slidable engagements of the protrusions 14, 15 and the slots 33, 43 makes the first and the second plugs 31, 41 smoothly enter the first socket 10*a* and the second socket 10*b* respectively.

Figure 8:
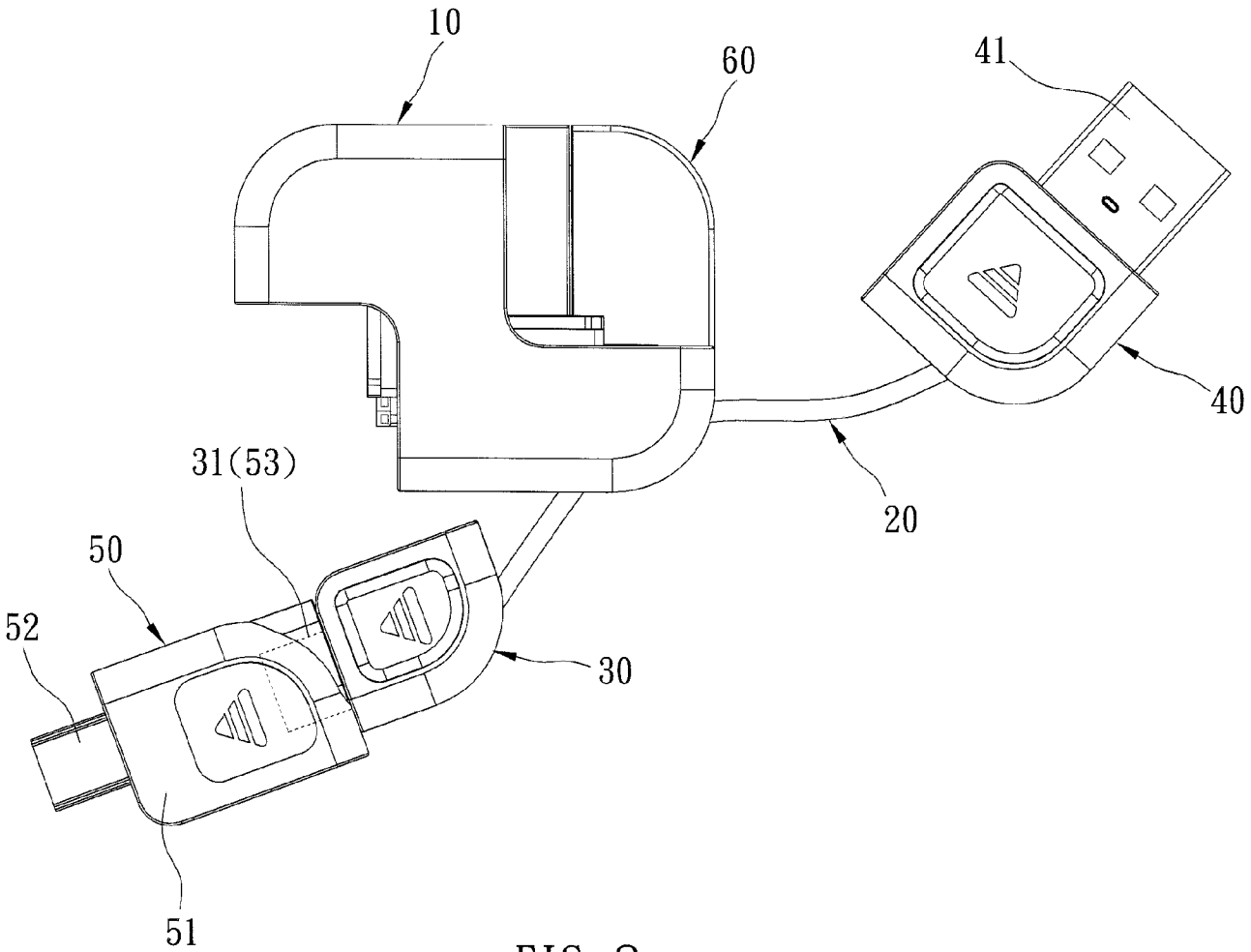
FIG. 8 is a top view of the preferred embodiment of the present invention, showing the serial connection of the first connector and the adapter.

The adapter 50 has a third housing 51, on which a third plug 52 and a socket 53 are provided. The third plug 52 is electrically connected to the socket 53. The third housing 51 further has a slot 54 to form a third connecting portion. The third plug 52 is inserted into the third socket 10*c*, and the slot 54 slidably engages the protrusion 16 to mount the adapter 50 on the main member 10. The main member 10 has a recess which receives the third housing 51 of the adapter 50, and the third socket 10*c* is on a sidewall of the recess. In an embodiment, the socket 53 of the adapter 50 fits the first plug 31 of the first connector 30 (FIG. 8). It may fit the second plug 41 of the second connector 40 alternately.

Figure 9:
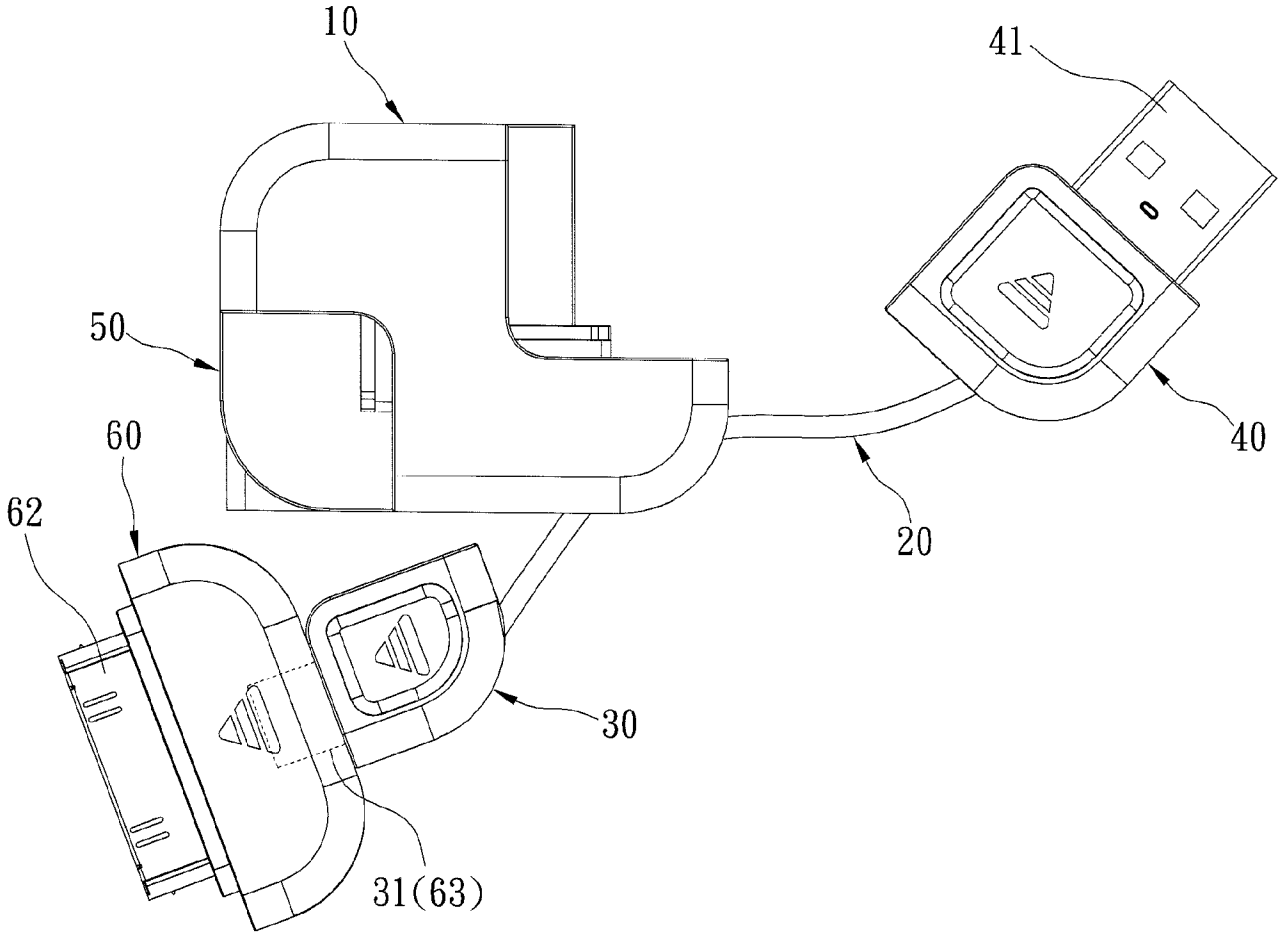
FIG. 9 is a top view of the preferred embodiment of the present invention, showing the serial connection of the first connector and another adapter.

The adapter 60 has a fourth housing 61, on which a fourth plug 62 and a socket 63 are provided. The fourth plug 62 is electrically connected to the socket 63. The fourth housing 61 further has a protrusion 64. The fourth plug 62 is inserted into the fourth socket 10*d*, and the protrusion 64 slidably engages the slot 17 to mount the adapter 60 on the main member 10. The main member 10 has a recess which receives the fourth housing 61 of the adapter 60, and the fourth socket 10*d* is on a sidewall of the recess. In an embodiment, the socket 63 of the adapter 60 fits the second plug 41 of the second connector 40 (FIG. 9). It may fit the first plug 31 of the first connector 30 alternately.

The adapters 50 and 60 are able to be pulled out to engage the first connector 30 and the second connector 40, or to engage other connectors. They are connected to the main member 10 as described above for storage. The slidable engagements of the protrusions 16, 64 and the slots 54, 17 makes the third plug 52 and the fourth plug 62 smoothly enter the third socket 10*c* and the fourth socket 10*d* respectively.

In conclusion, the USB connector module of the present invention provides a variety of plugs and sockets for connection, and they van be operated and stored in an easy way. The description above is only a few preferred embodiments of the present invention and the equivalence of the present invention is still in the scope of claim construction of the present invention.

What is claimed is:

1. A USB connector module, comprising:

a cable;

a first connector having a first plug connected to an end of the cable;

a second connector having a second plug connected to an opposite end of the cable;

at least an adapter having a third plug and a socket, wherein the third plug is electrically connected to the socket, and the first plug of the first connector is able to engage the socket; and a main member having a first socket to detachably engage the first plug of the first connector, a second socket to detachably engage the second plug of the second connector, and a third socket to detachably engage the third plug of the adapter.

2. The USB connector module as defined in claim 1, wherein the first connector has a connecting portion; the second connector has a connecting portion; the adapter has a connecting portion; the main member has three guiding portions to slidably engage the connecting portions of the first connector, the second connector, and the adapter respectively.

3. The USB connector module as defined in claim 2, wherein the first connector has a first housing, on which the connecting portion is provided; the second connector has a second housing, on which the connecting portion is provided; and the adapter has a third housing, on which the connecting portion is provided.

4. The USB connector module as defined in claim 3, wherein the main member has three recesses to receive the first housing of the first connector, the second housing of the second connector, and the third housing of the adapter respectively.

5. The USB connector module as defined in claim 2, wherein the connecting portions and the guiding portions respectively are a pair of a slot and a protrusion.

6. The USB connector module as defined in claim 2, wherein the main member has a first casing, a second casing, and a third casing in serial connection; the first socket and the second socket are between the first casing and the second casing; and the third socket is between the second casing and the third casing.

7. The USB connector module as defined in claim 1, wherein the main member has a bore, and the cable passes through the bore.

8. The USB connector module as defined in claim 7, wherein the main member has a cable slot communicated with the bore, and the cable is able to be squeezed in the cable slot.

9. The USB connector module as defined in claim 7, wherein the first connector and the second connector are larger than the bore.

* * * * *